United States Patent [19]

Magill

[11] 4,334,584

[45] Jun. 15, 1982

[54] METHOD AND APPARATUS FOR INSTALLING A SEA-FLOOR CELLAR IN A SUBSEA BOTTOM HAVING COMPACTED SOIL CONDITIONS

[75] Inventor: James M. Magill, Houston, Tex.

[73] Assignee: Atwood Oceanics, Inc., Houston, Tex.

[21] Appl. No.: 120,375

[22] Filed: Feb. 11, 1980

[51] Int. Cl.[3] ..... E21B 7/12

[52] U.S. Cl. ..... 175/5; 37/63; 175/65; 175/171; 405/226; 405/248

[58] Field of Search ..... 175/5, 65, 171; 166/222, 223; 405/226, 248; 37/63, 62, 61

[56] References Cited

U.S. PATENT DOCUMENTS

| | | | |
|---|---|---|---|
| 428,021 | 5/1890 | Rothwell . | |
| 908,113 | 12/1908 | Lovett | 37/62 |
| 1,356,646 | 10/1920 | Maher | 175/422 |
| 1,905,643 | 4/1933 | Johnson . | |
| 2,956,354 | 10/1960 | Vairer | 37/63 |
| 3,331,456 | 7/1967 | Pittman | 166/222 |
| 3,344,612 | 10/1967 | Rininger . | |
| 3,543,422 | 1/1970 | Plutchak | 37/63 X |
| 3,926,003 | 12/1975 | Norman . | |
| 3,965,687 | 6/1976 | Shaw | 405/226 |
| 4,123,858 | 11/1978 | Batchelder | 37/63 |

FOREIGN PATENT DOCUMENTS 1429312 3/1976 United Kingdom .

OTHER PUBLICATIONS

OTC 3250 "Shallow Water Drilling with Deep Water Drillship", Magill and Macan, OTC 1978, May 8–11.

"Deepwater Drillship Works in Shallowest Depth Ever", Reprint from Sep. 5, 1977, *Oil and Gas Journal.*

*Primary Examiner*—William F. Pate, III

*Attorney, Agent, or Firm*—Pravel, Gambrell, Hewitt, Kirk & Kimball

[57] ABSTRACT

A sea-floor cellar is installed in substantially in the sea-floor in a shallow water area where the distance between the sea-floor, which has a packed or rock ladened soil formation, and a drill ship is not sufficient to allow for normal positioning of a blowout preventer stack on the surface of the sea-floor. According to the method and apparatus of this invention, a first honeycomb of bore holes is drilled in the designated bottom area; a second honeycomb of bore holes having diameters larger than the first honeycomb of holes is then drilled into the designated bottom area to produce a second honeycomb of bore holes of larger diameter; and, a bar member is then rotated into the bore hole to eliminate soil structures left standing in the second honeycomb to produce a substantially clear recessed area for receiving the implantable sea-floor cellar to house a blowout preventer stack substantially below the surface of the subsea bottom.

9 Claims, 7 Drawing Figures

METHOD AND APPARATUS FOR INSTALLING A SEA-FLOOR CELLAR IN A SUBSEA BOTTOM HAVING COMPACTED SOIL CONDITIONS

TECHNICAL FIELD

The field of this invention relates to shallow water drilling operations where floating drilling vessels such as drill ships cannot normally be utilized and is directed to method and apparatus for implanting a sea-floor cellar substantially below the surface of the subsea bottom. In the past, it has been necessary to utilize jackup or submersible drilling units in shallow waters where the water depth was less than about 100 feet. Drill ships have required a greater working depth of water in order to provide sufficient distance in the riser system from the drilling floor to the ball joint of the blowout preventer stack to insure that horizontal movement of the drill ship from factors such as wind, waves and current will not cause the riser system to tilt from a vertical position so far that the riser system may be damaged. It is understood that a ball joint mounted at the top of a blow out preventor stack is generally designed to allow for riser tilt or pivot to an angle of about 10°; but, other stress factors typically limit the maximum desired tilt to approximately 5°. The utilization of drilling ships in water depths greater than 100 feet is workable because the horizontal offset of the vessel at the water surface caused by wave and wind action does not cause as great an angle of pivot or flex at the ball joint. Whenever drill ships have attempted to be used in water depths of less than 100 feet, it has been found that the amount of vessel movement caused by anticipated wind, waves and current may be sufficient to cause a tilt of the riser system of more than 5° thereby subjecting the entire riser system and blowout preventer stack to a higher possibility of failure. Thus as the water depth is decreased, the horizontal offset of the drill ship caused by wave and wind action causes a greater flex or tilting of the riser system at the ball joint thereby increasing the possibility of tilting the riser system beyond an allowable limit.

One possible solution to this problem is disclosed in U.S. Pat. No. 4,189,255, entitled "SEA-FLOOR SHORING CELLAR AND METHOD OF INSTALLING SAME" wherein a particular structure for a sea-floor cellar is disclosed. The sea-floor cellar disclosed in this patent application includes a substantially cylindrical retainer wall assembly having a hollow interior, an upper rim portion forming a top opening and a lower rim portion forming a bottom opening. Attachment means are mounted with the upper rim structure for attaching the retainer wall assembly to a suitable crane for lowering the sea-floor shoring cellar to the sea-floor from a drilling vessel. An annular air ejector is mounted within the retainer wall assembly adjacent the lower rim structure, the annular air ejector including means for connecting the air injector to a source of air under pressure. The annular air ejector includes a plurality of air nozzles directed generally vertically upwardly. A plurality of discharge tubes are mounted substantially within the interior of the retainer wall assembly and include an upper, exit portion extending outwardly from the retainer wall assembly and a bottom inlet portion positioned at least partly over the nozzles for directing air, water and solids received upwardly and outwardly of the retainer wall assembly. The sea-floor shoring retainer wall assembly disclosed in this patent is installed by first drilling a hole at approximately the center of the designated area on the ocean floor to be cleared. A jetting tool is then utilized to jet compressed air or other gas or drilling fluid in the area of the drilled hole to enlarge the hole to sufficient size to receive the retainer wall assembly. A T-bar jetting tool can also be used within the partly cleared hole to rotate therein and direct outwardly through a plurality of nozzles a jetting fluid to loosen up the soil of the subsea bottom, which soil is then removed by the suction action applied into the discharged tubes mounted on the retainer wall assembly.

It is stated in the referenced patent that the retainer wall assembly may be planted in various formations including hard and soft sea floors. However, it has now been determined that there are some formations which are too hard or compacted to utilize only the method set forth in the referenced application for preparation of the hole to receive the sea floor cellar.

SUMMARY OF THE INVENTION

It is the object of this invention to provide method and apparatus for installing a sea-floor cellar in soil formations which are too hard or compacted to practically use the method and apparatus set forth in the parent, referenced patent application. As used herein, the term "hard" refers to hard packed or compacted soil formations which may include rock or shell-packed areas which cannot typically be loosened by using fluid jetting action only. For example, such hard soil structure may consist of packed clay with coral and shells embedded therein.

This invention is directed to method and apparatus for installing a sea-floor cellar in shallow water areas wherein the subsea bottom has a compacted soil formation which is not readily displaced by fluid jetting action alone. In practicing the method of this invention, a first pattern of bore holes are drilled in the designated subsea location in a configuration generally the same as the sea-floor cellar to be installed substantially below the surface of the sea-floor. Drilling of this first pattern of holes produces a first honeycomb soil structure having substantially the same configuration and depth as the sea-floor cellar to be installed. A second pattern of bore holes is then drilled into the first honeycomb area, the second bore holes being of a larger diameter than the first drilled bore holes but in a similar pattern thereby producing a second honeycomb soil structure. A bar member is then inserted into this second honeycomb soil structure and rotated to eliminate any standing walls in the second honeycomb and to produce a substantially cleared recessed area to receive the sea-floor cellar. Additionally, fluid jetting action is utilized to further loosen and suspend soil particles during and after use of the rotating bar member in said second honeycomb of holes to create a cleared, recessed area having an outer wall of the same configuration as the sea-floor cellar and being of sufficient depth to receive the sea-floor cellar. The sea-floor cellar is then implanted in the cleared recessed area.

The apparatus of this invention includes a T-bar jetting tool adapted for attachment to a drill ship for insertion into a designated area in the ocean floor in order to clear out such designated area to receive a sea-floor cellar. The T-bar jetting tool includes a vertical section and a horizontal section attached to the vertical section at substantially the middle of the horizontal section. The vertical section is adapted to be attached to the drill string of a drill ship for positioning and rotating the T-bar jetting tool. The vertical and horizontal sections of the T-bar jetting tool are at least partly hollow to receive jetting fluid from the drill ship. The horizontal section of the T-bar jetting tool has a plurality of nozzles positioned to direct fluid outwardly and downwardly, the nozzles being spaced closer together along the horizontal section toward the outer end of the horizontal section.

In addition, the apparatus of this invention further includes an inverted, conically shaped tool adapted for attachment to a drill ship for insertion into a designated area in the ocean floor in order to clear out the designated area to receive the sea-floor cellar. The inverted, conically shaped tool includes a central post member adapted for attachment to the drill string of a drill ship for rotating the jetting tool. A plurality of inclined leg sections are attached to the lower end of the central post member and are angled upwardly and outwardly therefrom so that the upper ends of the inclined leg sections are in a common plane transverse to the central post member and the same radial distance away therefrom to form an inverted, conical structure whereby the inclined sections impact upon surrounding soil structure upon rotation of the jetting tool and break up hard-packed, rock-ladened soil during rotation thereof.

This Summary of the Invention is not intended to be limiting nor actually represent the subject matter which Applicant claims as his invention, which subject matter is set forth in the claims.

DESCRIPTION OF THE PREFERRED EMBODIMENT

Figure 1:
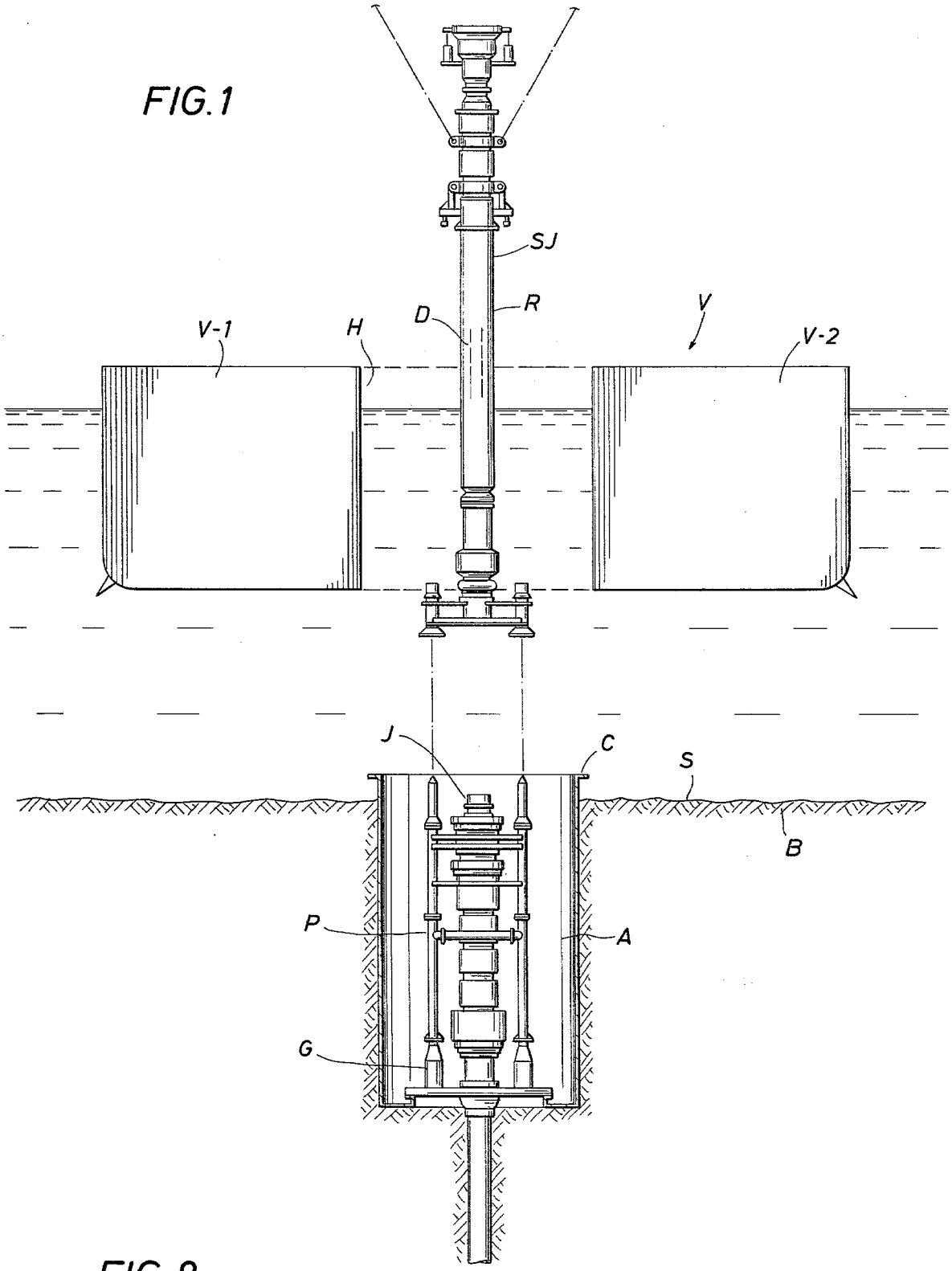
FIG. 1 is a side view partially in schematic illustrating the ultimate position of the sea-floor cellar substantially below the surface of the subsea bottom whereby the distance between the blowout preventer stack and the drill ship is sufficiently increased to allow drilling operations in more shallow water conditions.

In referring to the drawings and in particular FIG. 1, a sea-floor cellar C is illustrated in position in a recessed area A substantially below the surface S of the subsea bottom B. The subsea bottom B has a soil structure which may be considered substantially hard or compacted because of packed soil and/or the presence of substantial amounts of rock or shell, which makes it very difficult to utilize the fluid jetting action methods set forth in U.S. Pat. No. 4,189,255, filed June 28, 1978 entitled "SEA-FLOOR SHORING CELLAR AND METHOD OF INSTALLING SAME". It should be understood that the hard or compacted character of the soil structure of the subsea bottom B may be caused by many reasons, the important point being that the soil structure is resistant to jetting action methods alone which were disclosed in the referenced patent application.

A blowout preventer stack generally designated as P is illustrated in position within the sea-floor cellar C. Typically, such a blowout preventer stack includes a series of interconnected valves including various types of blowout preventers which are mounted onto a guide post structure G. The blowout preventer stack has mounted at its upper end a ball joint J which allows the riser system R to pivot or flex somewhat in response to wave and heave movement.

A drill ship vessel V is schematically illustrated as floating on the surface of the water in FIG. 1. The drill ship V is of a type well known in the art and includes an upper drilling platform (not shown) and all the various equipment utilized to drill offshore. Only opposing vessel sections V1 and V2 are schematically illustrated in FIG. 1, the space therebetween representing the drilling hole H which is located at substantially the middle of the drill ship and through which the riser system R extends. The hole H in the drill string D is sometimes referred to as a "moon pool". The riser system R is schematically illustrated as positioned above the guide post structure G located within the sea-floor cellar C. Of course, the riser system R is eventually mounted onto the ball joint J of the blowout preventer stack P so that the drill ship may operate a drill string D, riser system R, the blowout preventer stack P and into the hole below. The drill string D is only shown schematically telescoping drill string slip joint SJ having telescoping parts which allow the upper part of the riser system R to vertically move with the floating drill ship V. In addition to vertical movement, it is necessary to compensate for horizontal movement of the drill ship D in response to wind and wave action.

The amount of horizontal movement of the drill ship V is critical since the drill ship is connected through the riser system R to the blowout preventer stack P. Whenever there is a horizontal displacement of the drill ship D, the entire riser system R must pivot or flex about the ball joint J in order to prevent failure stresses being imposed on the riser system R. Typically, the ball joint J is designed to allow about a 10% tilt or pivot from vertical, but it has been found desirable to limit that tilt to about 5°, taking into account a fail-safe factor. Since the amount of tilt increases as the distance of the drill ship V from the blowout preventer stack P decreases, it has been found difficult to utilize drill ships in shallower waters where the distance from the water surface to the floor S of the subsea bottom B is less than about a 100 feet. In such cases, the invention set forth in U.S. Pat. No. 4,189,255, may be utilized so long as the soil structure will allow the sea floor cellar disclosed in that patent application to clear a recess area A utilizing principally fluid jetting action.

It has been found that a very hard or compacted formation makes it very difficult to practice the method set forth in the referenced patent application and therefore, this invention is directed to method and apparatus for implanting a sea-floor cellar C in such a hard subsea bottom soil structure.

Referring to FIGS. 2–8, method and apparatus are illustrated for installing the sea-floor cellar C in a hard or compacted subsea bottom soil structure. In practicing the method of his invention, it is first necessary to drill a first pattern generally designated as 10 of hole individually identified by the number 11. This pattern 11 is in substantially the same configuration 12 as the cylinderical wall of the sea-floor cellar C shown in FIG. 1. In this manner, a first honeycomb-like soil structure 14 is produced, the first honeycomb 14 thus includes a pattern 10 of holes 11 having a locus of center lines 15*a* and 15*b* which intersect at right angle. Solid soil structure areas 16 remain between the holes 11.

For example, it has been found advantageous to drill holes 11 of a diameter of 3 feet wherein the distance between the center points of adjacent holes is 5 feet. This leaves a minimum distance of 2 feet of standing soil 16 in the first honeycomb structure 14. The pattern 10 of holes 11 of the first honeycomb 14 is of substantially the same circular area as the circular transverse cross section of the cylindrical retainer wall of the sea-floor cellar C. In addition, the holes 11 are drilled deeper than the depth of the sea-floor cellar C a distance such as about 3 feet.

Figure 7:
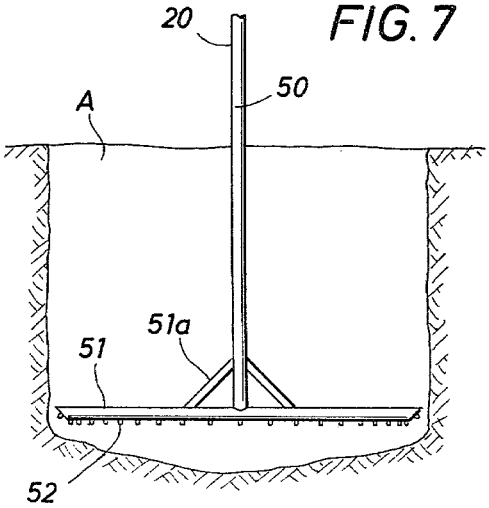
FIG. 7 is a side view illustrating the positioning of a T-bar jetting tool in the second honeycomb structure illustrated in FIG. 6 in order to substantially clear out any remaining standing walls.

At this point, it may be desirable to utilize the T-bar jetting tool 20 illustrated in FIG. 7 to clear any loose soil from the top portion of the first honeycomb soil structure 14. However, the T-bar jetting tool 20 is not be sufficiently strong to effectively tear down the remaining wall structures 16 of the first honeycomb 14. The structure of the T-bar jetting tool 20 illustrated in FIG. 7 will be described in detail later.

Referring to FIGS. 3–6, an inverted, conically shaped tool 25 is utilized to produce a second honeycomb 26 of holes 27 of a larger diameter than the holes 11 of the first honeycomb 14. The configuration or area cleared in the second honeycomb 26 is the same as that defined by circle 12 in FIG. 2. In the soil structure shown in FIG. 6, the holes 27 are drilled or bored in a second pattern defined as 28.

Figure 3:
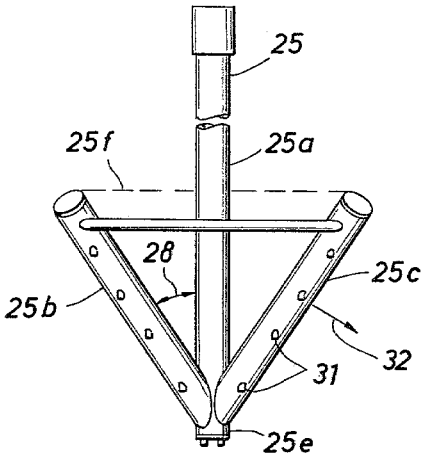
FIG. 3 is a side view of an inverted, conically shaped tool which is utilized to drill a second honeycomb soil structure having larger holes than the first honeycomb.
Figure 4:
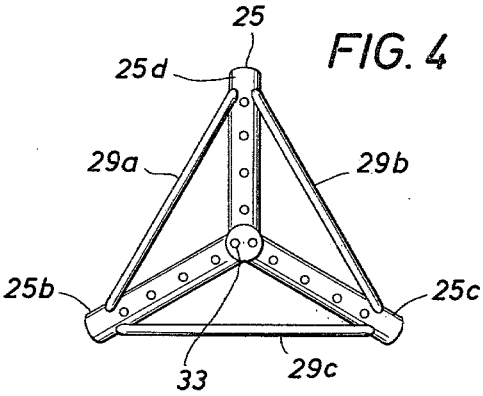
FIG. 4 is a bottom view of the inverted, conically shaped tool of FIG. 3.

Referring to FIGS. 3 and 4, the inverted, conically shaped tool 25 includes a central post member 25*a* adapted for attachment to a rotary drill string D. Three inclined leg sections 25*b*, 25*c* and 25*d* are welded onto the lower end 25*e* of the central post member 25 and extend upwardly and outwardly at an inclined angle 28. The upper ends of each of the inclined leg sections terminate in a common plane illustrated by dotted lines 25*f* transverse to the central post member 25*a* and at equal radial distances from the central post member 25*a*. The inclined leg sections 25*b*–25*d* cooperate to create an inverted, conically shaped member 25 having outwardly extending inclined leg sections, which extend radially outwardly as viewed from the bottom view of FIG. 4. The radius or distance of the upper ends of the leg sections 25*b–d* from central member 25*a* is greater than the radius of the first holes 11. Reinforcing members 29*a*, 29*b* and 29*c* may be welded in a common plane between the inclined leg sections 25*b–d* in order to reinforce and support the inclined leg sections in the conically-shaped position.

The central post member 25*a* and each of the inclined leg sections 25*b–d* are at least partly hollow in order to receive a jetting fluid flowing through the rotating drill string D-1. The fluid which may be air or other gas, or liquid, is directed outwardly through nozzles. Each of the inclined leg section includes a plurality of nozzles 31 which directs outwardly fluid at a downwardly inclined angle in the direction of arrow 32. A pair of nozzles 33 are also positioned in the bottom end 25*e* of the central post member 25 to direct the jetting fluid downwardly. Fluid is circulated through the interior of drill string D and into the central post member 25*a* and inclined leg sections 25*b–d* during rotation of the inverted, conically shaped tool into the first honeycomb soil structure 14 of FIG. 2.

Figure 5:
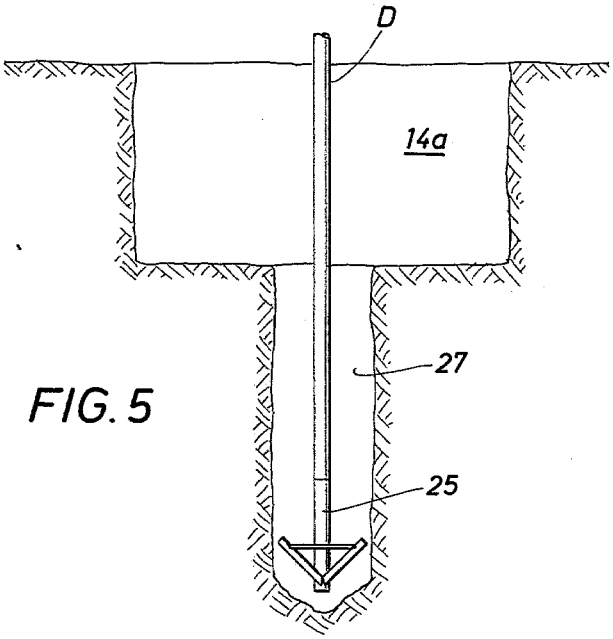
FIG. 5 illustrates the inverted, conically shaped tool of FIGS. 3 and 4 in operating position in the first honeycomb of FIG. 2.

In utilization, the inverted, conically-shaped tool 25 is rotated into the first honeycomb soil structure 14 in a second pattern 28 which may be defined by a central hole 27*a* surrounded by five equally spaced holes 27*b* within the circular area 12. FIG. 5 shows the inverted, conically shaped tool 25 actually drilling out a hole 27 to form a second honeycomb 26. The outwardly inclined leg sections 25*b–d* of the inverted, conically shaped tool break up the standing walls 16 between the holes 11 of the first honeycomb 14 as the tool is rotated and moved downwardly to create the holes 27.

Figure 6:
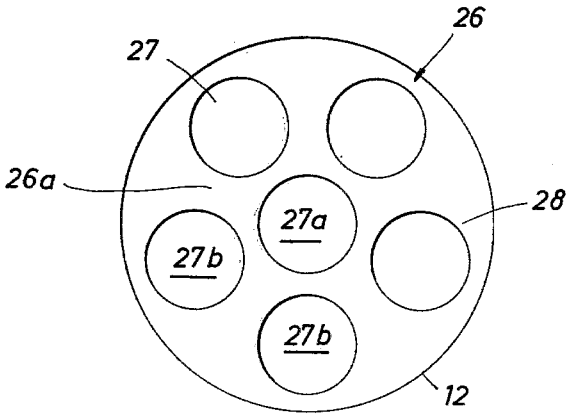
FIG. 6 is a top, schematic view of the second honeycomb structure produced by utilization of the inverted, conically shaped tool of FIGS. 3 and 4.

The inverted, conically shaped jetting tool is utilized five times to create the holes 27*a*, 27*b* in the second pattern 28 illustrated in FIG. 6, thereby creating the second honeycomb 26 having walls 26*a* of soil remaining standing within the area A to be cleared. It should be noted that the diameter of each of the holes 27 of the second honeycomb 26 produced by rotation of the inverted, conically shaped tool 25 are of a larger diameter than the holes 11 of the first honeycomb 14.

During rotation of the inverted, conically shaped tool 25 the outwardly inclined leg sections 25*b–d* break up the standing walls 16 of the first honeycomb into smaller pieces. The jetting action of fluid being directed outwardly through nozzles 31 and 33 simultaneously with rotation of the tool 25 further helps break up the soil into smaller particles. The smaller of the broken pieces of soil may be removed utilizing the air lift device of FIG. 8 while the larger pieces of broken up soil may have fallen into the remaining part of the first holes 11 which were drilled to a deeper depth than the second holes 27. As an alternative, the second holes 27 may also be drilled to the same depth as the first holes 11, which is a depth greater than the depth necessary to actually house the sea-floor cellar C, thereby allowing some area at the bottom to receive the larger pieces of broken up soil.

Figure 8:
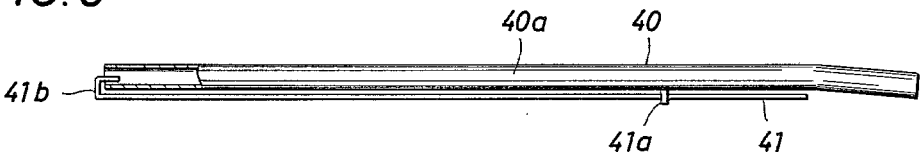
FIG. 8 illustrates a portable air lift device for removing loosened soil utilized at various stages to clear the recessed area for the sea-floor cellar.
Figure 2:
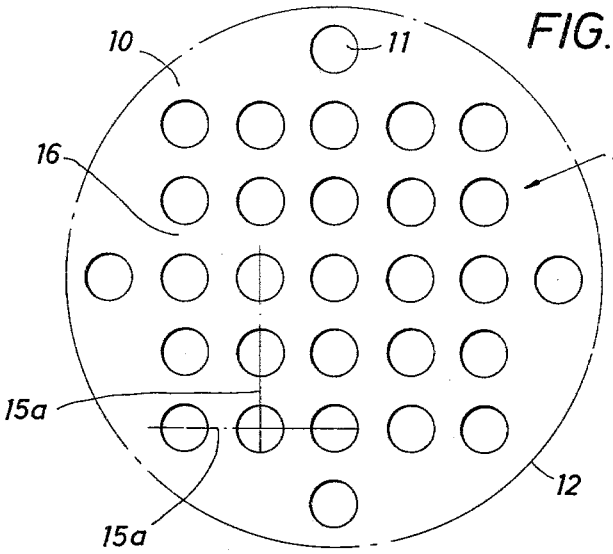
FIG. 2 is a top view in schematic illustrating the first pattern of holes drilled to form the first honeycomb soil structure in the designated ocean floor area to be cleared.

The air lift device 40 of FIG. 8 utilized to suck up the smaller particles of broken-up soil includes a tubular member 40*a* which is a wand-like member which may be attached to piping extending upwardly through the moon pool H to the deck of the drill ship V. A flexible line 41 is attached by brackets such as 41*a* to the tubular member 40*a* and includes an L-shaped end portion 41*b* which extends into the bottom end of the tubular member 40*a*. Air or other gas, or liquid, is pumped through the air line 41 and directed upwardly into the interior of the tubular member 40*a* to create a suction at the bottom end of the tubular member 40*a* to suck up smaller particles. Utilization of this portable suction device 40 allows for removal of smaller particulate and sediment from the area A. The portable airlift device 40 may be utilized at various points in the practice of this invention in addition to utilization of the device 40 after creation of the second honeycomb structure 26 illustrated in FIG. 6.

Referring to FIG. 7, the T-bar jetting tool 20, which may have already been utilized to clear a top portion 14*a* of the recessed area A of loose particulate is now utilized in the second honeycomb 26 to break up the remaining walls 26*a* of the honeycomb 26.

The T-bar jetting tool 20 is also lowered from the drilling vessel V through the moon pool H and includes a generally vertical section 50 welded to the center of a horizontal bar section 51 in order to provide an inverted T-shaped appearance as viewed in FIG. 7. Reinforcing members 51*a* may be welded between the horizontal section 51 and vertical section 50 in order to support the structure. The vertical section 50 and the horizontal section 51 are both hollow in order to receive fluid from the drill ship V. A plurality of nozzles 52 are mounted into the bottom of the horizontal section 51 to direct outwardly fluid flowing through the vertical section 50 and horizontal section 51 of the T-bar jetting tool. The nozzles 52 are positioned closer together along the bottom of the horizontal section 51 as the distance of the nozzles from the vertical section 50 becomes greater. In this manner, closed spaced nozzles are located radially outwardly from the vertical section 50 to compensate for the pressure drop of the fluid flowing through the horizontal section so that the jetting action is substantially the same across the entire length of the horizontal section 51 of the T-bar jetting tool 20. It should be noted that the T-bar jetting tool substantially as shown in FIG. 7 was also disclosed in the U.S. Pat. No. 4,189,255. However, the positioning of the nozzles 52, as well as the particular application and use described herein, is a new feature. It is within the scope of the invention to mount the section 51 of T-bar jetting tool 25 in only a partly horizontal position, so long as there is sufficient horizontal portion to break up the remaining standing walls 26*a*. The width of the bar section 51 is substantially equal to the desired final dimension of the hole A.

After the area A is fully clear such as is illustrated in FIG. 7, the sea-floor cellar C may then be installed by lowering from the drill ship V through the moon pool H into position substantially below the surface S of the subsea bottom B. The sea-floor cellar C, which was described in U.S. Pat. No. 4,189,255, includes means to remove particulate as the cellar is lowered into area A. The portable air lift device 40 can also be used to remove particulate after use of the T-bar jetting tool 20. In this manner, the blowout preventer stack P may be housed within the sea-floor cellar C substantially below the surface S of the subsea bottom B thereby increasing the distance from the blowout preventer stack P to the drill ship V. This allows the drill ship vessel V to be utilized in shallower water conditions where ordinarily the drill ship vessel V could not be so utilized.

The foregoing disclosure and description of the invention are illustrative and explanatory thereof, and various changes in the size, shape and materials as well as in the details of the illustrated construction may be made without departing from the spirit of the invention. For example, the term fluid has been utilized with respect to the various jetting tools such as tools 25 and 50. It should be understood that the term fluid may include air or other gases, water, drilling fluid or other liquids so long as the necessary jetting action is provided. Furthermore, it is conceivable that method and apparatus of this invention may be utilized to house the blowout preventer structures below the surface S of the subsea bottom for other reasons. For example, in some water conditions, the presence of ice or ship traffic may make it desirable to house the blowout preventer stack below the surface S of the subsea bottom. The method and apparatus of this invention may be utilized in those situations, also.

I claim:

1. A method of installing a sea-floor cellar in shallow water areas in order to position a blowout preventer stack substantially below the surface of the sea floor, which has a hard or compacted soil structure, comprising the steps of:

drilling a first pattern of first bore holes in a configuration generally the same as the sea-floor cellar to be installed in order to produce a first honeycomb soil structure of substantially the same configuration and depth as the sea-floor cellar to be installed;

drilling a second pattern of bore holes into said first honeycomb wherein each bore hole of said second pattern has a larger diameter than the bore holes in said first pattern thereby producing a second honeycomb soil structure;

inserting a bar member into said second honeycomb of bore holes, and rotating said bar member therein to eliminate standing walls in said second honeycomb to produce a substantially cleared recessed area;

utilizing fluid jetting action to further loosen and suspend said particles during and after use of said rotating bar member in said second honeycomb of holes to create a clear, recessed area having outer walls of a configuration and sufficient depth to receive said sea-floor cellar; and implanting such sea-floor cellar in said recess while simultaneously removing at least some of such suspended particulate.

2. The method set forth in claim 1, including:

drilling said second pattern of holes with a rotating tool having an inverted, conical end portion having a radius at its inverted base larger than the radius of the individual holes of said first honeycomb.

3. The method set forth in claim 1, including:

rotating said bar member in said second honeycomb of bore holes to substantially eliminate standing walls and applying a fluid jetting action through said bar member to further loosen said second honeycomb.

4. The method set forth in claim 1, including:

said bar member having a horizontal bar segment of dimension approximately equal to the desired final dimension of said cleared recessed area.

5. The method set forth in claim 4, including:

applying fluid jetting action through said horizontal bar segment in a downward direction to further loosen particles in said substantially cleared recess area.

6. The method set forth in claim 5, including:

applying said fluid jetting action approximately equally across the length of said horizontal bar segment.

7. The method set forth in claim 2, including:

applying fluid jetting action through said inverted, conical end portion of said rotating tool as said tool member is rotated in said first honeycomb.

8. A system for installing a sea-floor cellar substantially in the ocean floor in shallow water areas where the distance between the sea-floor, which has a packed or rock-ladened soil formation, and the drill ship is not sufficient to allow for normal positioning of a blowout preventer stack at the surface of the ocean floor, comprising:

an inverted, conically shaped jetting tool adapted for attachment to such drill ship for insertion into a designated area of a soil formation, which area must be cleared in order to receive an implantable sea-floor cellar therein for housing a blowout preventer stacks substantially below the surface of the ocean floor;

such first inverted conically shaped tool including a plurality of outwardly angled leg sections attached to a central post member whereby such leg sections break up the surrounding soil upon rotation of the central post member;

a second T-shaped jetting tool adapted for attachment to such drill ship and for extension into a hole at least partially cleared by said first inverted, conically shaped jetting tool, said second jetting tool having a T-shape and including a lower, horizontal section attached at its center point to a vertical section adapted for attachment to such drill ship, said horizontal section being rotatable within said substantially clear recessed area in order to further clear such area of soil formation to receive said implantable sea-floor cellar; and a portable suction means adapted for lowering from said drill ship into said designated area to remove loose particulate produced from the rotative action of said first and second jetting tool.

9. The system set forth in claim 8, further including:

said inverted, conically shaped jetting tool including means for directing outwardly from said angled leg section fluid in order to enhance the breaking up of the soil formation in which said T-shaped jetting tool is rotated; and said T-shaped jetting tool horizontal section including a plurality of nozzles directed downwardly for further breaking up such soil formation during rotation thereof.

* * * * *